US005988194A

United States Patent [19]

Collins

[11] Patent Number: 5,988,194

[45] Date of Patent: Nov. 23, 1999

[54] METHOD AND SYSTEM FOR ANCHORING A TEMPORARY STRUCTURE

[76] Inventor: Larry Phillip Collins, 686 Richardson Rd., Owosso, Mich. 48867

[21] Appl. No.: 09/014,024

[22] Filed: Jan. 27, 1998

[51] Int. Cl.[6] ..... E04H 15/62

[52] U.S. Cl. ..... 135/118; 135/119; 52/155; 52/156; 248/530; 248/156

[58] Field of Search ..... 135/118, 119; 52/4, 155–158, 162; 248/156, 530, 508

[56] References Cited

U.S. PATENT DOCUMENTS

| | | | |
|---|---|---|---|
| 781,221 | 1/1905 | Morris | 52/156 |
| 1,120,406 | 12/1914 | Reach | 52/156 |
| 1,349,476 | 8/1920 | Solberg | 52/156 |
| 1,904,700 | 4/1933 | Starks | 135/118 X |
| 2,156,021 | 4/1939 | Little | 135/118 |
| 3,306,560 | 2/1967 | Wheeler | 248/530 |
| 3,498,305 | 3/1970 | Hulin . | |
| 4,063,567 | 12/1977 | Martin et al. . | |
| 4,222,401 | 9/1980 | Allweil . | |
| 4,404,980 | 9/1983 | Wade . | |
| 4,432,382 | 2/1984 | Wolf . | |
| 4,543,972 | 10/1985 | Bennett et al. | 135/118 |
| 4,831,798 | 5/1989 | Otteson . | |
| 5,625,983 | 5/1997 | Lachance et al. . | |
| 5,662,134 | 9/1997 | Auer . | |

*Primary Examiner*—Carl D. Friedman
*Assistant Examiner*—Winnie Yip
*Attorney, Agent, or Firm*—Young & Basile, P.C.

[57] ABSTRACT

An anchoring system and method for temporary structures is disclosed. The system comprises: At least a first stake having a shaft with a lower end for insertion into the ground, and an upper end including a loop; at least a second stake having a shaft with a lower end for insertion into the ground, and an upper end including at least one hook. When the lower ends of the at least first and second stakes are inserted into the ground, the lower ends of the stakes are angled away from each other, the shaft of the second stake is received through the loop of the first stake, and a portion of the shaft of the first stake is received within the at least one hook, whereby the at least first and second stakes are in a mutually interlocked condition which prevents the at least first and second stakes from being independently extracted from the ground.

10 Claims, 2 Drawing Sheets

FIG-2
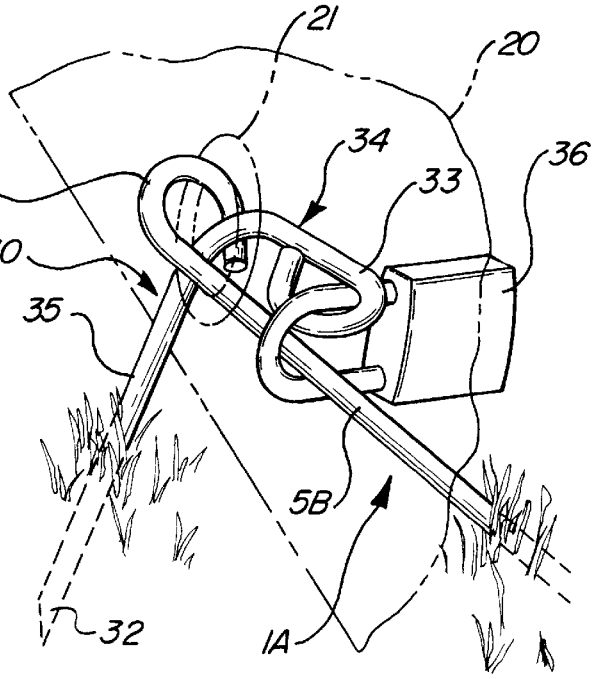
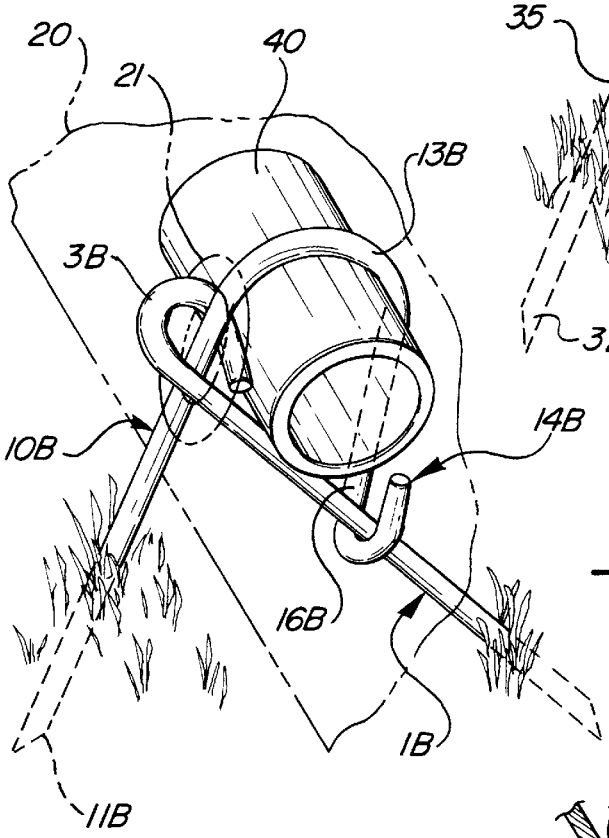
FIG-3
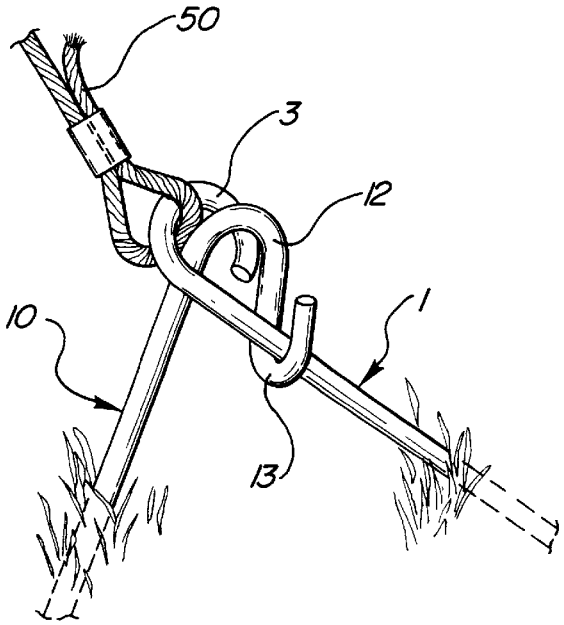
FIG-4

METHOD AND SYSTEM FOR ANCHORING A TEMPORARY STRUCTURE

FIELD OF INVENTION

This invention relates to a method and system for anchoring a temporary structure such as a tent or the like, and more specifically to stakes for such purpose.

BACKGROUND OF INVENTIONS

Temporary structures such as tents and the like have long been used for shelter. Anchoring such structures in place using stakes is common practice. The stakes are typically inserted into the ground, so as to capture part of the tent or a tent support. Examples of several prior art tent anchoring stakes and systems follow.

U.S. Pat. No. 4,404,980, issued to Wade, teaches using two straight tent stakes to secure a support bar to the ground. The first stake is inserted from inside the tent outwards through a support bar at a 45 degree angle with respect to the ground. The second stake is inserted from outside the tent at a 45 degree angle with respect to the ground, so as to be generally perpendicular with respect to the first stake. In this invention, removing the ground support bar requires a force large enough to overcome two opposing stakes.

U.S. Pat. No. 4,831,798, issued to Ottenson, teaches a stake having an elongate cylindrical body and a bail, the bail connected to or formed integrally with the body. The stake may be used alone or, to increase the anchoring strength, two stakes can be used together. When two stakes are used together, the first stake is driven into the ground so that a majority of the bail is below ground level. A chain or rope type tent support is connected to and securely retained by the exposed portion of the bail. The second stake is then inserted into the ground such that the bail of the second stake engages the first stake, retaining the second stake in the ground.

U.S. Pat. No. 4,063,567, issued to Martin et al., teaches a tent peg having an elongate body with an aperture and shoulder thereon. The tent peg is driven into the ground at approximately a 45 degree angle. A locking peg or nail is then driven through the aperture in the tent peg into the ground approximately perpendicular to the tent peg until the locking peg abuts the tent peg preventing withdrawal of the tent peg. In Martin, as in Ottenson, only one peg is locked in place and the other peg may be freely retracted.

U.S. Pat. No. 5,625,983, issued to Lachance et al., teaches an anchoring device comprising two essentially identical stakes with superimposable eyelets and a cross-shaped sliding sleeve member with two tubes, one for receiving each stake. The stakes are inserted into the ground through the tubes approximately perpendicular to each other. The eyelets may then be superimposed and locked with an external means such as a padlock.

SUMMARY OF THE INVENTION

It is an object of this invention to provide an anchoring system and method for a temporary structure, the system and method comprising two mutually interlocking stakes.

The mutually interlocking anchoring system and method of the present invention can be used to secure either the temporary structure itself or to secure a support thereof, such as a rope or chain, at least one of the stakes providing a universal pivot point for the support.

According to the present invention, at least first and second mutually interlocking stakes are provided. The first stake has a shaft having a lower end designed for insertion into the ground and an upper end comprising a loop. The second stake has a shaft including a lower end designed for insertion into the ground and an upper end comprising a first "U" shaped hook proximate the upper end and a second "U" shaped hook adjacent the first hook, the second hook oriented in a plane angled relative to the plane of the first hook. According to one embodiment, the first stake is inserted through a grommet in a wall of the temporary structure. The second stake is inserted through the grommet from the opposite side of the wall, through the loop of the first stake, and into the ground. The second stake is then twisted so that the second "U" shaped hook captures the shaft of the first stake, thereby mutually interlocking the stakes.

Another embodiment of the invention comprises a first stake, identical to the first stake described hereinabove, and a second stake having a loop at its upper end similar to the first stake, but oriented in a plane angled relative to the longitudinal axis of the shaft of the second stake. The first and second stakes are inserted into the ground and mutually interlocked in a manner similar to that described above, except that the stakes require a separate interlocking device, such as a padlock, to lock the loop of the second stake to the shaft of the first stake.

A third embodiment comprises first and second stakes identical to the first embodiment described, except that the first "U" shaped hook of the second stake is large enough to capture a frame member located along the bottom wall of a temporary structure. The stakes are mutually interlocked as in the first embodiment locking the frame member in place.

Other objects and advantages of the present invention will become apparent to those skilled in the art from the drawings and written specification.

BRIEF DESCRIPTION OF DRAWINGS

FIG. 2 is a perspective view of a second embodiment of this invention illustrating the separate interlocking device;

FIG. 3 is a perspective view of a third embodiment of this invention illustrating the mutually interlocking stakes capturing a frame member of a temporary structure;

FIG. 4 is a perspective view of this invention being used to secure a tent rope or chain support for a temporary structure.

DETAILED DESCRIPTION OF THE INVENTION

Figure 1:
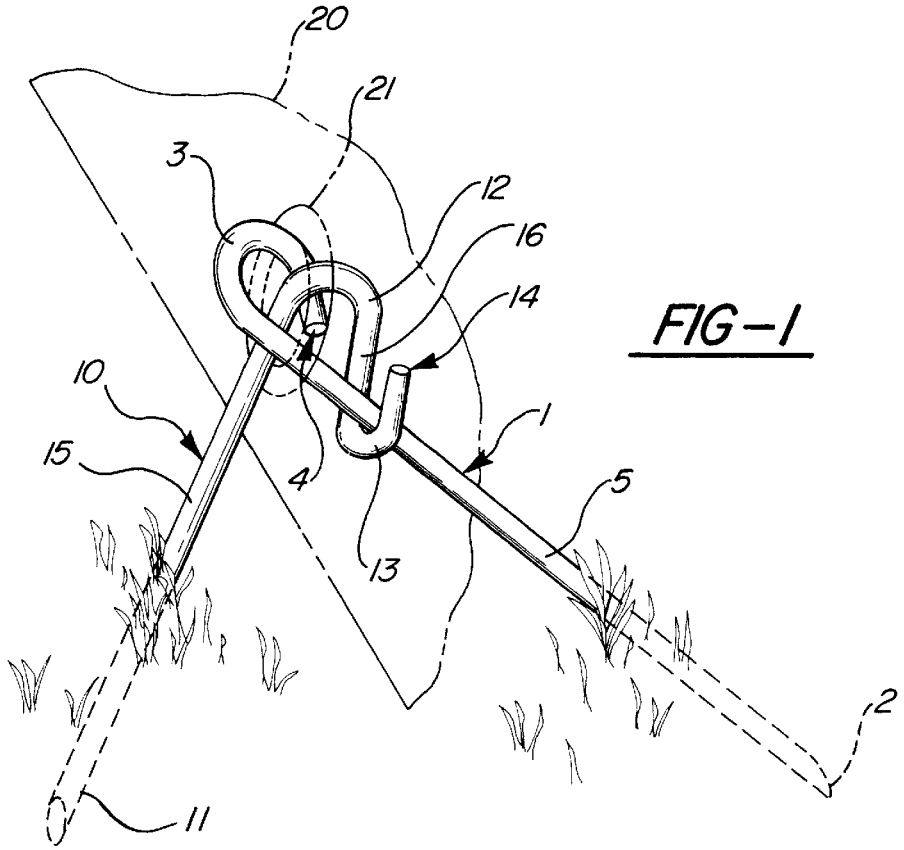
FIG. 1 is a perspective view of the first embodiment of this invention illustrating the mutually interlocking stakes.

Referring now to the drawings, the anchoring system and method of the present invention will be described in detail. While those skilled in the art will realize that the stakes of this invention can be used for anchoring tents, shelters, or other temporary structures, reference to a tent will be made herein in describing the illustrated embodiments in order to simplify the specification.

As shown in FIG. 1, the anchoring system of one embodiment of the present invention comprises first 1 and second 10 stakes. The stakes are formed out of metal, although they may be manufactured out of any other suitable material, such as plastics or composites, using known technologies. The stakes may be of any convenient size depending on the temporary structure to be supported, the nature of the ground, soil conditions, or other environmental factors. First stake 1 comprises an essentially straight shaft 5 with an upper end 4 and a lower end 2 for insertion into the ground. To ease insertion into the ground, lower end 2 may be pointed. Upper end 4 comprises a loop 3 formed integrally therewith. Those of skill in the art will appreciate that loop 3 may also be formed separately and attached to first stake 1 using known methods. Loop 3 may be completely closed or left open to allow the user to secure supports such as ropes or chains thereto. The diameter of loop 3 is preferably large enough to prevent it from passing through a grommet 21 in the wall of the temporary structure 20. Second stake 10 also comprises an essentially straight shaft 15 with an upper end 14 and a lower end 11 for insertion into the ground. Lower end 11 may also be pointed to ease insertion into the ground. Upper end 14 comprises a first "U"shaped hook 12 and a second "U" shaped hook 13 adjacent to first hook 12, the second hook oriented in a plane angled relative to the plane of first hook 12. An intermediate section 16 connects first 12 and second 13 hooks.

In operation of the first embodiment, first stake 1 is inserted through a grommet 21 or another opening in a tent 20 from outside of tent 20 and driven into the ground inside the tent at an angle. Loop 3 must be positioned such that the plane parallel to the opening thereof is not perpendicular with respect to the bottom edge of tent 20. Extra force can be applied to loop 3 using a hammer, foot, etc., as required in order to drive first stake 1 into the ground. Next, lower end 11 of second stake 10 is inserted through grommet 21 from inside tent 20, through loop 3 of first stake 1, and into the ground at an angle. First stake 1 is locked in place by loop 3, which captures shaft 15 of second stake 10. To mutually interlock the two stakes together, second stake 10 is twisted (clockwise in the drawings) so that shaft 5 of first stake 1 is received in second hook 13. In practice it has been found that second stake 10 may have to be extracted from the ground slightly to fully receive shaft 5 of first stake 1 in second hook 13.

In the aforedescribed mutually interlocked condition, neither stake is removable independent of the other. It will be appreciated that second stake 10 cannot be extracted from the ground without twisting second stake 10 because shaft 5 of first stake 1 is restrained by the second hook 13.

While the order of insertion of first 1 and second 10 stakes into the ground is critical to effect mutual interlocking, it will be appreciated by those of skill in the art that the direction of insertion of the stakes with respect to the tent wall is not critical to the present invention.

Illustrated in FIG. 2 is a second embodiment of the invention having a first stake 1A identical in form and function to first stake 1 described herein above. Second stake 30 of the second embodiment comprises an essentially straight shaft 35 with an upper end 34 and a lower end 32 designed for insertion into the ground. Upper end 34 comprises a loop 33 oriented in a plane angled relative to the longitudinal axis of shaft 35. Loop 33 may be either open or closed, but in either case is preferably large enough so that it will not pass through a grommet 21 in tent 20.

In operation, first stake 1A is inserted through grommet 21 as explained above in conjunction with the first embodiment. Next, second stake 30 is inserted through grommet 21 from inside tent 20, through loop 3A of first stake 1A, and into the ground at an angle. A separate mutually interlocking device 36, such as the illustrated padlock, securely connects loop 33 of second stake 30 to shaft 5B of first stake 1 thereby mutually interlocking the stakes. Of course, those of skill in the art will appreciate that any separate mutually interlocking device known in the art, such as a tie clip, a twist tie, or even rope or string, can be used to mutually interlock the stakes without departing from the spirit of the present invention.

To remove the stakes, separate mutually interlocking device 36 must be removed, then second stake 30 is withdrawn from the ground, allowing first stake 1A to be withdrawn thereafter.

In the illustrated embodiment of FIG. 2, interlocking device 36 is fastened on the interior of tent 20. As previously discussed, however, the direction of insertion of the stakes with respect to the tent wall is not critical to the present invention. Accordingly, the location of interlocking device 36 is also not critical.

In a third embodiment of the present invention, illustrated in FIG. 3, first stake 1B is identical to first stake 1, described herein above, in both form and function. Second stake 10B is identical to second stake 10, also described herein above, except that first "U" shaped hook 13B of second stake 10B is preferably of sufficient dimensions to receive a portion of tent frame member 40 therein. In a tent, frame member 40 runs along the bottom of the tent and is used to attach other tent support members. In the illustrated embodiment, frame member 40 comprises ⅞ inch steel tubing; however, those of skill in the art will of course appreciate that the shape and size of the frame member is not critical to the present invention.

In operation, first stake 1B is inserted in the same manner described in conjunction with first stake 1 in FIG. 1 except that first stake 1B must be under frame member 40. Lower end 11B of second stake 10B is then inserted from inside tent 20 through grommet 21 above frame member 40 through loop 3B and positioned so that the first U-shaped hook 13B receives frame member 40 therein. As shown, first stake 1B passes under frame member 40 and into the ground at approximately a forty-five degree angle. Second stake 10B is inserted into the ground at approximately a forty-five degree angle deep enough so that upper end 14B is below the plane of first stake 1B and the second "U" shaped hook does not interfere with first stake 1B or the support member. Second stake 1B is then twisted (clockwise in the drawings) so the second hook captures the shaft of first stake 1B. To fully capture the shaft of first stake 1B, second stake 10B may have to be withdrawn from the ground slightly to prevent any further rotation thereof.

Of course, it will be appreciated with respect to each of the foregoing embodiments of the present invention that grommets 21 are not necessary for operation of the present invention and the stakes may be inserted through any opening in tent 20, even a hole created by the tent stakes themselves. It will likewise be appreciated that the angle of insertion is not critical to the invention. To maximize anchoring strength, however, each first and second stake is preferably inserted into the ground at a forty-five degree angle, such that the stakes are oriented perpendicular to each other.

Figure 5:
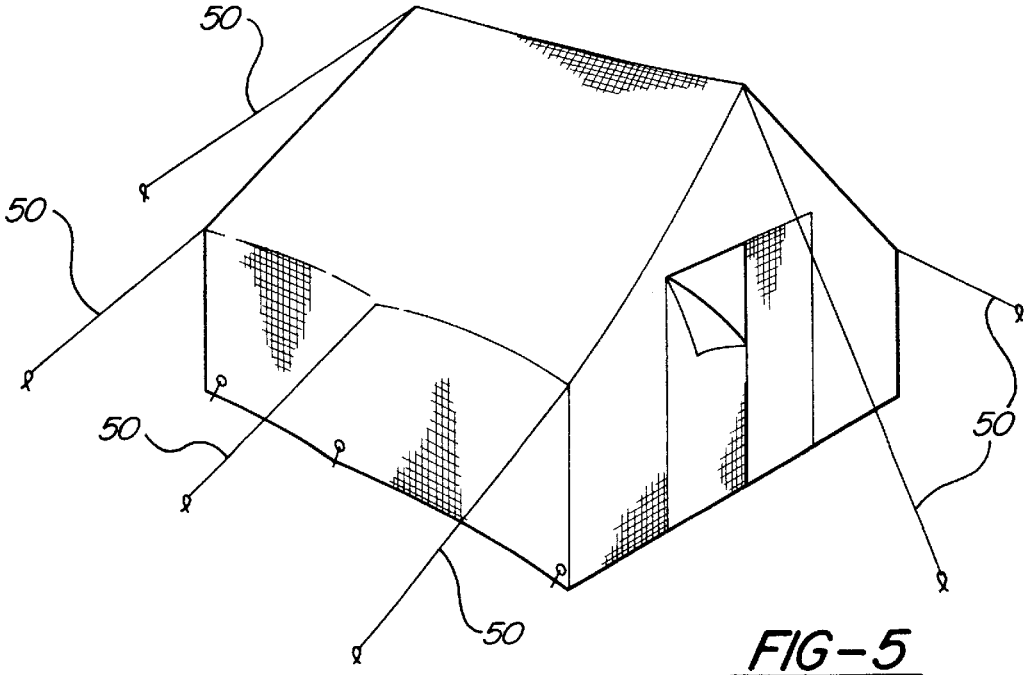
FIG. 5 is a perspective view of a temporary structure illustrating use of this invention.

Referring now to FIGS. 4 and 5, it will be appreciated that the stakes of the first or second embodiment can also be used to secure tent supports 50, such as ropes, chains, or the illustrated cable. First and second stakes are inserted into the ground and mutually interlocked in the same manner as previously discussed in association with FIGS. 1 and 2 at an appropriate distance from the tent to keep the supports taut. Support 50 is then attached to loop 3 of first stake 1, which loop serves as a universal pivot point. Support 50 may also be attached to first 1 or second 10 stakes before either is driven into the ground.

Since minor changes and modifications varied to fit particular operating requirements and environments will be understood by those skilled in the art, this invention is not considered limited to the specific examples chosen for purposes of illustration herein. The invention is rather meant to include all changes and modifications which do not constitute a departure from the true spirit and scope of this invention as claimed in the following claims and represented by equivalents to the claimed elements.

The invention in which an exclusive property or privilege is claimed is defined as follows:

1. An anchoring method for a temporary structure, comprising:

providing a temporary structure having a wall;

providing a first stake including a shaft having a lower end for insertion into the ground, and an upper end including a loop;

providing a second stake including a shaft having a lower end for insertion into the ground, and an upper end, said upper end of said second stake including at least one hook;

inserting said first stake through the wall of the temporary structure and into the ground;

inserting said second stake oppositely through the wall of the temporary structure, through said loop of said at least first stake, and into the ground; and positioning said second stake such that a portion of said shaft of said first stake is received within said at least one hook.

2. The anchoring method of claim 1, wherein the temporary structure includes a frame member, said second stake further includes a hook dimensioned to receive a portion of said frame member therein, such that when said second stake is inserted into the ground, the frame member is received within said hook.

3. An anchoring system for a temporary structure, comprising:

at least a first stake having a shaft with a lower end for insertion into the ground, and an upper end including a loop;

at least a second stake having a shaft with a lower end for insertion into the ground, and an upper end including at least one hook; and wherein, when said lower ends of said at least first and second stakes are inserted into the ground, said lower ends of said at least first and second stakes are angled away from each other, said shaft of said second stake is received through said loop of said first stake, and a portion of said shaft of said first stake is received within said at least one hook, whereby said at least first and second stakes are in a mutually interlocked condition which prevents said at least first and second stakes from being independently extracted from the ground.

4. The anchoring system of claim 3, wherein the temporary structure is of the type including a frame member, and wherein said second stake further includes a hook dimensioned to receive a portion of the frame member therein such that, when said second stake is inserted into the ground, the frame member is receivable within said hook.

5. The anchoring system of claim 3, wherein said loop of said first stake defines a closed loop.

6. An anchoring system for a temporary structure, comprising:

at least a first stake having a shaft with a lower end for insertion into the ground, and an upper end including a loop;

at least a second stake having a shaft with a lower end for insertion into the ground, and an upper end including a loop;

wherein, when said lower ends of said at least first and second stakes are inserted into the ground, said shaft of said second stake is received through said loop of said first stake, and said lower ends of said at least first and second stakes are angled away from each other; and an interlocking device for connecting said shaft of said first stake and said loop of said second stake whereby, when said shaft of said first stake and said loop of said second stake are connected by said interlocking device, said at least first and second stakes are in a mutually interlocked condition which prevents said at least first and second stakes from being independently extracted from the ground.

7. The anchoring system of claim 6, wherein said loop of said second stake is oriented in a plane angled relative to the longitudinal axis of said shaft of said second stake.

8. The anchoring system of claim 6, wherein said interlocking device comprises a padlock.

9. The anchoring system of claim 6, wherein said interlocking device comprises a twist tie.

10. The anchoring system of claim 6, wherein, when said lower ends of said at least first and second stakes are inserted into the ground, said shaft of said second stake is received through said loop of said first stake, and said shaft of said first stake is received through said loop of said second stake.

* * * * *